US006582060B1

(12) United States Patent
Kitakami et al.

(10) Patent No.: US 6,582,060 B1
(45) Date of Patent: Jun. 24, 2003

(54) LIQUID EJECTING METHOD, LIQUID EJECTING HEAD AND LIQUID EJECTING APPARATUS

(75) Inventors: Koichi Kitakami, Chigasaki (JP); Tamon Itaya, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/300,791

(22) Filed: Apr. 28, 1999

(30) Foreign Application Priority Data

Apr. 28, 1998 (JP) ..... 10-119614
Apr. 28, 1998 (JP) ..... 10-119615

(51) Int. Cl.[7] ..... B41J 2/05
(52) U.S. Cl. ..... 347/56
(58) Field of Search ..... 347/56, 61

(56) References Cited

U.S. PATENT DOCUMENTS 5,621,447 A 4/1997 Takizawa et al. ..... 347/88
5,754,202 A 5/1998 Sekiya et al. ..... 347/63

FOREIGN PATENT DOCUMENTS

DE 43 23 707 1/1993
DE 195 05 465 8/1995
EP 0 641 654 3/1995
JP 60-161973 8/1985
JP 63-221121 9/1988
JP 2-141219 5/1990
JP 4-10941 1/1992

OTHER PUBLICATIONS

Crivello, J.V. et al., "New Photoinitiators for Cationic Polymerization", J. Polymer Sci.: Symposium No. 56, pp. 383–95 (1976).

*Primary Examiner*—John Barlow
*Assistant Examiner*—Michael S Brooke
(74) *Attorney, Agent, or Firm*—Fitzpatrick, Cella, Harper & Scinto

(57) ABSTRACT

A liquid ejection method wherein a bubble is created in the liquid on a heat generating member provided on a substrate by thermal energy generated by the heat generating member, by which a droplet of the liquid is ejected, the method comprising the steps of contacting to the substrate such a portion of gas-liquid interface between the bubble and the liquid as is not contacted to the substrate by deformation of the bubble: and causing the bubble to be in fluid communication with ambiance simultaneously with or after the contact between the portion and the substrate.

6 Claims, 10 Drawing Sheets

LIQUID EJECTING METHOD, LIQUID EJECTING HEAD AND LIQUID EJECTING APPARATUS

BACKGROUND OF THE INVENTION

Field of the Invention

The present invention relates to a liquid ejecting method, a liquid ejecting head, and a liquid ejecting apparatus, which record an image on a piece of recording medium by ejecting liquid in the form of a droplet so that the liquid adheres to the recording medium.

A liquid ejecting recording method for recording an image by adhering liquid to a piece of recording medium by ejecting liquid in the form of a droplet from an ejection orifice with the use of thermal energy is superior to the other recording methods in that it can record a high quality image, it can record in high resolution, it can record at a high speed, it can record with low noise, it can easily record in color, and it can record on ordinary paper.

In order to produce a high quality image with the use of a liquid ejecting recording method, it is necessary to stabilize the volume by which liquid is ejected in the form of a droplet. Therefore, a liquid ejecting recording method has been devised in various ways. For example, according to the method proposed in Japanese Laid-Open Patent Application No. 10941 or the like, a bubble is generated in the liquid in a liquid path leading to an ejection orifice, with the use of thermal energy, and the liquid in the liquid path is ejected from the ejection orifice while allowing the bubble to open into the atmosphere under a condition that the linear differential value of the velocity, at which the leading end of the bubble in terms of the direction in which the bubble is ejected, is negative. In a liquid ejecting head which employs this method, the distance from the heater for generating thermal energy to an ejection orifice is relatively short. Therefore, a liquid ejecting head which employs this method is better than the prior liquid ejecting head in terms of the ratio of the electrical energy given to the heater relative to the amount of work accomplished by the bubble. In other words, this liquid ejecting method is superior to the prior liquid ejecting methods in terms of energy efficiency. Further, in the case of this method, the liquid present between the heater and the ejection orifice is almost entirely ejected, which makes this method superior to the prior methods in terms of the uniformity of the volume by which liquid is ejected each time.

However, there was much to be improved in the conventional liquid ejecting technology such as the one described above. For example, the conventional technologies can reduce the amount of splashing or misting of the liquid, by ejecting the liquid droplet while allowing a bubble to open into the atmosphere under the condition that the linear differential value of the velocity of the leading end of the bubble in terms of the liquid ejecting direction is negative. In other words, the conventional technologies can prevent image quality from being reduced by the splashing or misting of the liquid. However, the conventional technologies leave much to be desired in terms of the amount by which they reduce the image quality degradation by preventing the splashing or misting of the liquid.

Further, in the case of the conventional liquid ejecting method, at the time of liquid ejection, a small column of liquid is formed for an extremely short period of time at the center portion of an ejection orifice, and the point at which a bubble becomes connected to, or integrated with, the atmosphere is mostly adjacent to this column of liquid. In other words, a bubble comes in communication with, or becomes integrated with, the atmosphere at a point away from the center of the ejection orifice. As a result, the trailing end of a bubble does not align with the center of the ejection orifice. This affects the direction in which the liquid droplet flies, affecting thereby the accuracy with which the liquid droplet lands on the target point on the recording medium. Also in terms of this aspect of liquid ejection, the conventional technologies must be greatly improved to keep recording quality at a high level.

As described above, preventing liquid from being splashed or misted, and also improving the accuracy with which each liquid droplet lands on the target point on recording medium, so that recording quality is further improved, are extremely important objects for a liquid ejection method.

SUMMARY OF THE INVENTION

The primary object of the present invention is to provide a liquid ejecting method, a liquid ejecting head, and a liquid ejecting apparatus, which are stable in terms of the volume by which liquid is ejected each time, the velocity at which liquid is ejected, and the point on which the liquid lands.

Another object of the present invention is to provide a liquid ejecting method, a liquid ejection head, and a liquid ejecting apparatus, which can prevent the ejected liquid droplet from splashing or misting.

Another object of the present invention is to provide a liquid ejecting method, a liquid ejecting head, and a liquid ejecting apparatus, which make it possible to record at a high level of recording quality.

Another object of the present invention is to provide a liquid ejecting method which ejects liquid in the form of a droplet by forming a bubble in the liquid on a heat generating member with the use of thermal energy generated by the heating member provided on a piece of substrate, and which comprises a process in which a bubble deforms in such a manner that the center portion of the bubble wall, or the interface between the liquid and vapor, in other words, the bubble wall portion on the side opposite to the substrate, makes contact with the substrate, and a process in which the bubble opens into the atmosphere, at its periphery, at the same time, or after, the contact between the aforementioned center portion of the bubble wall and the substrate.

Another object of the present invention is to provide a liquid ejecting head which comprises a plurality of ejection orifices through which liquid is ejected in the form of a droplet, a plurality of liquid paths leading to the plurality of liquid ejection orifices, one for one, a plurality of heat generating members faced, one for one, toward the plurality of liquid ejection orifices to generate the thermal energy used for forming bubbles so that liquid is ejected from the plurality of liquid ejection orifices, a piece of substrate on which the plurality of heating members are disposed, and in which a bubble deforms in such a manner that the center portion of the bubble wall makes contact with the substrate, and a process in which the bubble opens into the atmosphere, at its periphery, at the same time, or after, the contact between the center portion of the bubble wall and the substrate, and also to provide a liquid ejecting apparatus which comprises such a liquid ejecting head.

According to the present invention, the trailing end portion of the column of liquid, that is, a portion of the interface between the vapor portion (bubble) and the liquid, almost perfectly aligns with the central axis of the corresponding ejection orifice, at the same time as, or preferably before, the bubble opens into the atmosphere. The column of liquid flies away from the ejection orifice, following substantially the central axial line of the ejection orifice, with the trailing end of the column of liquid remaining in contact with the surface the corresponding substrate until the distance between the leading end of the column of liquid and the surface of the substrate becomes substantial. Therefore, the column of liquid remains straight, and flies away straight in the form of a droplet after it becomes separated from the substrate surface.

Further, according to the present invention, a bubble, or the vapor portion, becomes connected to the atmosphere, in the liquid path, adjacent to the substrate, at the same time as, or preferably immediately before, the column of liquid becomes a liquid droplet, that is, at the same time, or preferably immediately before, the trailing end of the column of liquid is separated from the liquid in the liquid path, in the ejection orifice, adjacent to the substrate surface. Therefore, the liquid is prevented from splashing or misting, and should the splashing or misting of the liquid ever occur, the splashed or misted liquid is prevented from being ejected out of the liquid path. Further, the liquid is ejected by a constant volume, at a constant velocity, and the trailing end of the liquid droplet, that is, the trailing end of the column of liquid, always behaves the same. Therefore, image quality is not derogatorily affected by satellite liquid droplets. As a result, a high quality image can be recorded.

Further, according to the present invention, a bubble opens into the atmosphere. In other words, the process in which a bubble shrinks and perishes does not exist. Therefore, the heaters are prevented from being damaged by cavitation. As a result, a liquid ejecting head lasts longer.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
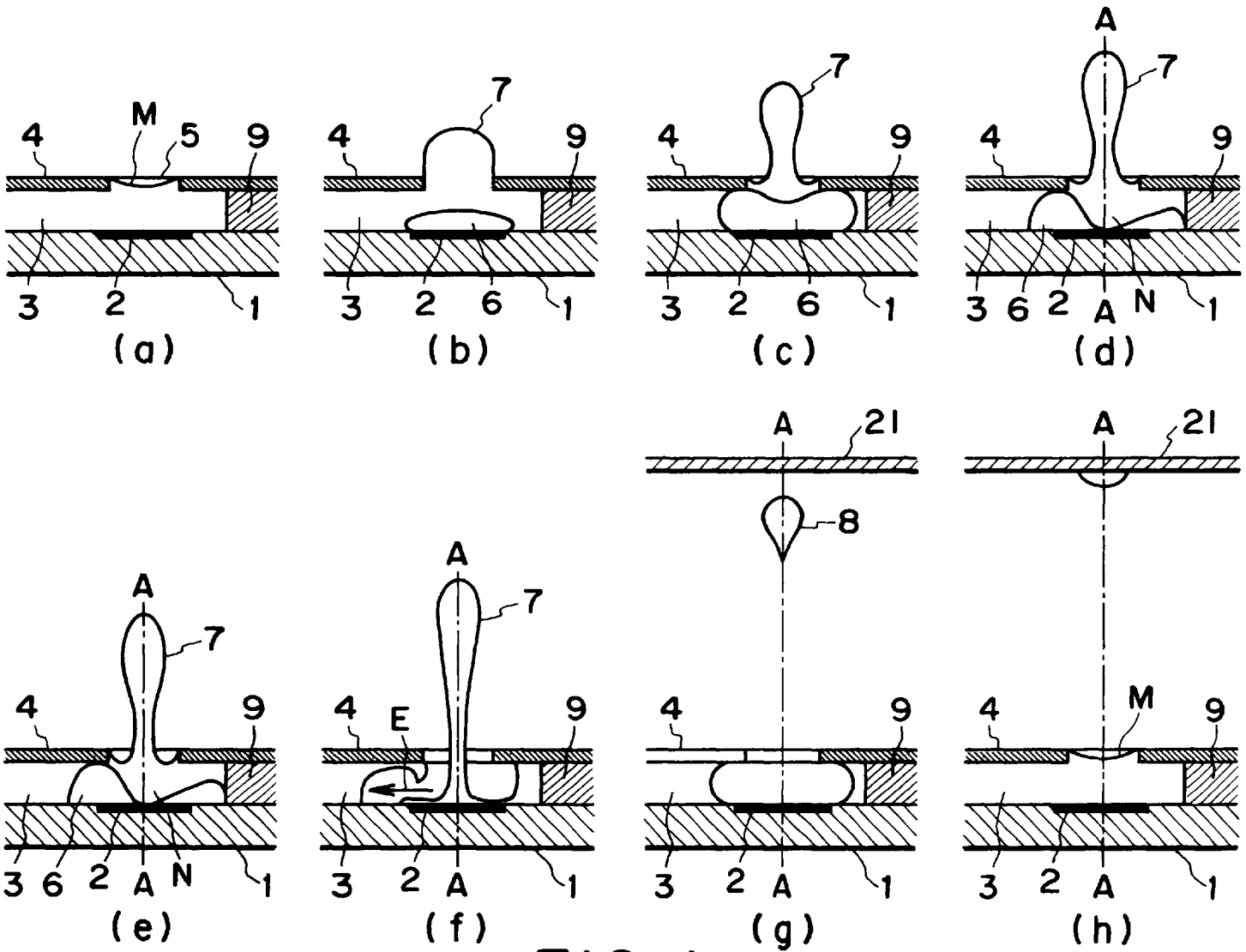
FIGS. 1, (*a*)–(*h*), are schematic sectional views of an ejection orifice and the adjacencies thereof, and depict the sequence in which a bubble is formed, and liquid is ejected, by a liquid ejecting method in accordance with the present invention.

Hereinafter, the preferred embodiments of the present invention will be described with reference to the appended drawings. FIGS. 1, (*a*)–(*h*), relate to an embodiment of the liquid ejecting method in accordance with the present invention. They are schematic sectional views of the essential portion of a liquid ejecting head of the so-called side shooter type, according to which an ejection orifice squarely faces a heat generating member (hereinafter, "heater"). They depict the sequence in which a bubble is formed, and liquid is ejected, by a liquid ejecting method in accordance with the present invention. The liquid ejection principle described hereinafter is not limited (affected) by whether or not the liquid ejection direction is perpendicular to the surface of a heater.

In these drawings, a referential character 1 designates a piece of element substrate formed of silicon. On this substrate 1, a heater 2, as a thermal energy generating means for generating the thermal energy used for ejecting liquid, is formed. There is disposed an orifice 5 above the substrate, squarely facing the heater 2. The orifice 5 is a hole through which liquid is ejected in the form of a droplet. This ejection orifice 5 is formed in an orifice plate 4 positioned a predetermined distance, equal to the height of a side wall 9, away from the substrate 1. The space surrounded by the orifice plate 4, substrate 1, and side wall 9 constitutes a liquid flow path. The liquid flow path is filled with liquid ink 3 which is supplied as necessary from an ink supplying portion (unillustrated) located on the upstream side of the ejecting orifice 5. There is formed a meniscus M across the opening of the ejection orifice 5. A referential character 6 designates a bubble generated as the ink 3 is substantially instantaneously heated by the heater 2. A referential character 7 designates a portion of the liquid ink, which has been caused to swell in the form of a column, from the ejection orifice 5, by the pressure from the bubble 6. A referential character 8 designates the portion of the ink having been ejected in the form of a droplet from the ejection orifice 5 by the pressure from the bubble 6.

Next, referring to FIGS. 1, (*a*)–(*h*), an embodiment of the liquid ejecting method in accordance with the present invention will be described.

FIG. 1, (*a*), depicts the initial state of a liquid ejecting head, that is, the state immediately before the liquid ejecting head begins to be driven, in which the liquid flow path is filled with the ink 3.

Next, referring to FIG. 1, (*b*), as an electric signal is given to the heater 2 through an unillustrated electrode, the heater 2 generates heat, and the ink adjacent to the heater 2 begins to boil in the so-called film boiling manner, generating thereby a bubble 6. As the volume of the bubble 6 rapidly changes (grows), a portion of the ink is caused to swell in the form of a column 7 of liquid from the ejection orifice 5. The bubble 6 continues to grow for a short while, but it suddenly begins to collapse from the center portion, due to the balance among the volume of the column of ink 7 grown outward from the ejection orifice 5, the internal pressure of the bubble 6, and the like, as shown in FIGS. 1, (*c*) and (*d*). As the bubble 6 shrinks, the trailing end N of the column of ink 7, that is, a portion of the interface between the bubble 6 (vapor) and the ink 3, partially comes in contact with the top surface of the heater 2 as shown in FIG. 1, (*e*). In the stage depicted in FIG. 1, (*e*), the bubble 6 is substantially in the form of a ring.

Normally, when designing a side shouter type liquid ejecting head, in which the ejection orifice 5 is disposed to squarely face the heater 2, the center of the heater 2 and the center of the ejection orifice are aligned with each other. This is because it is assumed that the line connecting these two centers constitutes the direction in which ink is ejected (single dot line designated by a referential character combination A—A in FIG. 1, (*f*)).

When the aforementioned portion of the interface between the bubble (vapor) and the liquid is caused to come in contact with the heater 2 on the substrate 1, the location of the contact is desired to be within the projection of the outside opening of the ejection orifice 5 upon the substrate 1, or the projection of the inside opening of the ejection orifice 5, that is, the opening of the ejection orifice 5 on the liquid flow path side, upon the substrate 1. It is more desirable if the aforementioned portion of the interface is caused to come in contact with the substrate 1, at the point within both of the projections. As long as the point of contact between the trailing end of the column of ink 7 and the top surface of the heater 2 falls within the aforementioned specific area, the liquid is ejected in the form of a droplet in the direction substantially along the single dot line A—A in FIG. 1. In other words, the direction in which liquid is ejected is stabilized.

Next, referring to FIG. 1, (*f*), the leading end of the column of ink 7 continues to move away (fly away) from the ejection orifice 5 even after the trailing portion of the column of ink 7 comes in contact with the heater 2. However, at the same time as the trailing end of the column of ink 7 contacts the heater 2, or preferably, immediately after the contact (several microseconds after the contact, most preferably, between 0.5 to 1 microsecond after the contact), the bubble 6 is caused to open into the atmosphere. This is for the following reason. That is, if the bubble 6 is not allowed to come into communication, or become integrated, with the atmosphere even after the trailing end of the column of ink 7 comes in contact with the heater 2, the trailing end of the column of ink 7 comes in contact with the heater 2, at a point away from the center of the heater 2, due to the behavior of the bubble 6. This affects the direction in which the column of ink 7 is ejected. As a result, the accuracy with which an ink droplet lands on the recording medium is affected; it becomes impossible to cause an ink droplet to land on a predetermined point on the recording medium. Further, after the trailing end of the column of ink 7 contacts the heater 2, the bubble 6 remains intact for a brief moment, and then collapses. As the bubble 6 collapses, the internal pressure of the liquid flow path suddenly changes, causing the liquid flow path to be damaged by cavitation, which is serious problem. Thus, in order to prevent this kind of problem, it is important that the bubble 6 is allowed to become integrated with the atmosphere at the same time as the trailing end of the column of liquid 7 makes contact with the element substrate, or preferably, immediately thereafter.

Further, according to this embodiment, it is assured that the bubble 6 becomes integrated with the atmosphere at a point which is within the liquid flow path and is substantially distant from the ejection orifice 5, and also that the trailing end of the column of ink 7 makes contact with the element substrate 1. Therefore, the direction E in which the atmospheric air flows into the liquid flow path as the bubble 6 becomes integrated with the atmosphere becomes opposite to the ejection orifice 5, as shown in FIG. 1, (*f*). As a result, the splashing or misting of ink, which occurs when the bubble 6 becomes integrated with the atmosphere, remains within the liquid flow path; the amount of the ink splashed or misted out of the ejection orifice 5 is very small. Therefore, recording quality is prevented from being degraded by the splashing, misting, or the like, of the ink.

Next, after stretching to a certain length, and becoming slim, the column of ink 7 breaks away from the ink in the liquid flow path, becoming an ink droplet 8, as illustrated in FIG. 1, (*g*). The ink droplet 8 lands on a piece of recording medium 21; in other words, recording is made. Then, the liquid flow path is supplied with the ink 3 from an ink container (unillustrated), through a common liquid chamber. As a result, the meniscus M is allowed to return to the opening of the ejection orifice 5. In other words, the liquid ejecting head restores the aforementioned initial stage, becoming ready for the next ink ejection operation.

Figure 2:
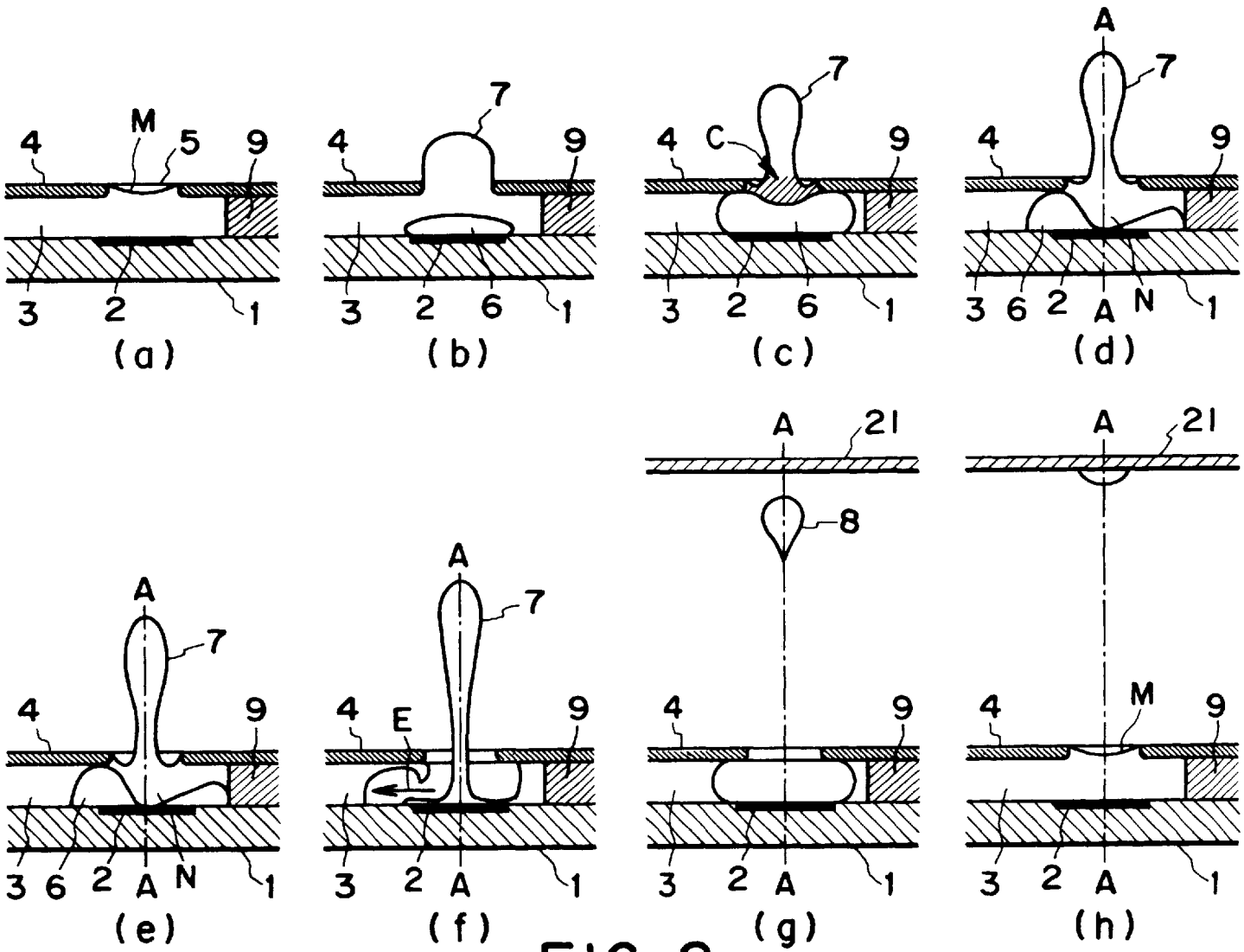
FIGS. 2, (*a*)–(*h*), are schematic sectional views of an ejection orifice and the adjacencies thereof, and depict the sequence in which a bubble is formed, and liquid is ejected, by another liquid ejecting method in accordance with the present invention.

FIGS. 2, (*a*)–(*h*), are schematic sectional views of the essential portion of another liquid ejecting head in accordance with the present invention, and depict the sequence in which a bubble is formed, and ink is ejected, by another ink ejection method in accordance with the present invention. The difference between the liquid ejecting head illustrated in FIG. 1 and the liquid ejection head illustrated in FIG. 2 is in the shape of the ejection orifice of the orifice plate. More specifically, in this embodiment, the inward opening of the ejection orifice, that is, the opening on the liquid flow path side, is greater in size than the outward opening of the ejection orifice. Further, the edge portion of the inward opening of the ejection orifice is rounded. The operational difference between the two heads traceable to this structural difference between the two will be described later. The sequence depicted by FIGS. 2, (*a*)–(*h*), in which a bubble is generated, and liquid is ejected, by this liquid ejecting method in accordance with the present invention, is substantially the same as the sequence depicted by FIGS. 1, (*a*)–(*h*).

Next, a method for measuring the position and time at which the trailing end of the column of ink 7 makes contact with the element substrate, and a method for measuring the time at which the bubble 6 becomes integrated with the atmosphere, will be described. In principle, the transformation of the bubble 6, and the state of contact between the bubble 6 and the heater 2, are observed with the use of an optical microscope or the like, while casting pulsating light from a strobe, a light emitting diode, or a laser, upon the bubble 6, from the orifice plate 4 side of a liquid ejecting head, or from the side surface side of a liquid ejecting head.

Figure 3:
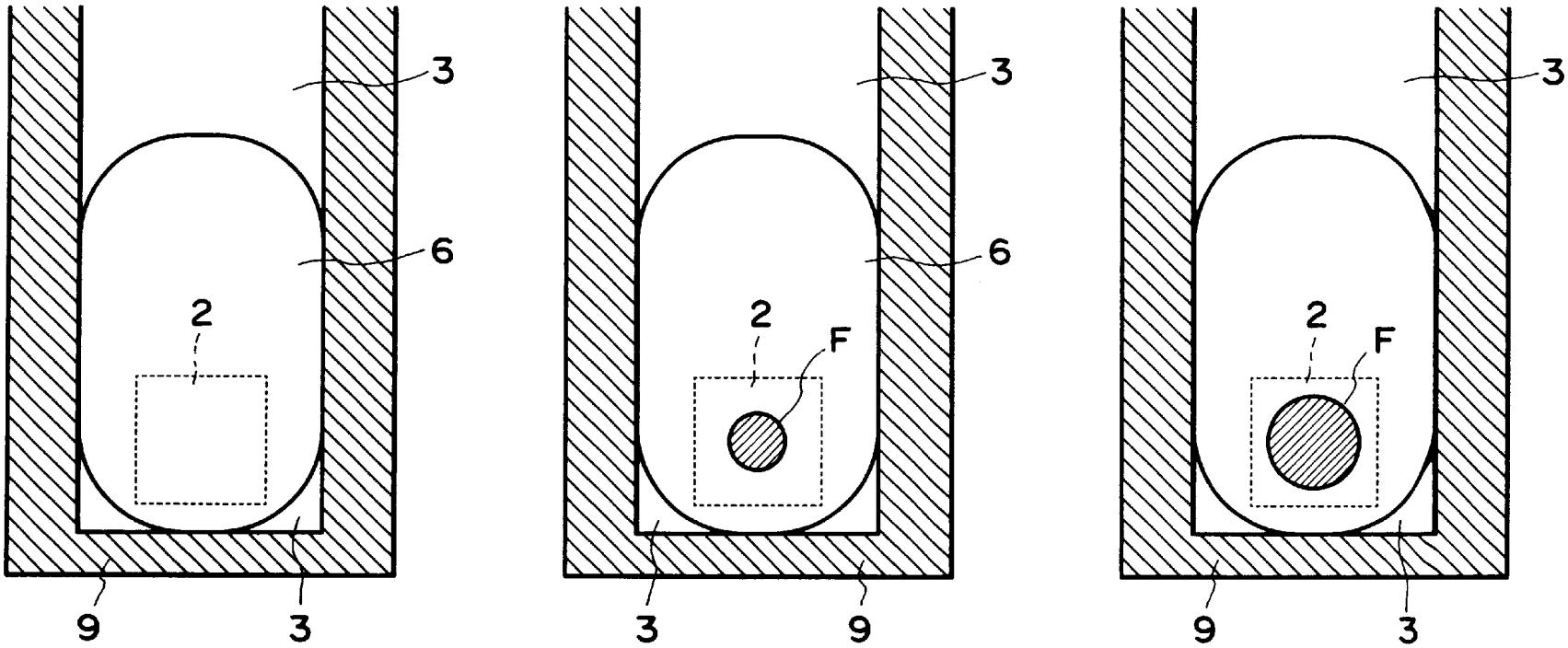
FIGS. 3, (*a*)–(*c*), are schematic sectional views of an ejection orifice and the adjacencies thereof, perpendicular to the liquid ejection direction, and depict the sequence in which the state of contact between the trailing end of the column of ink and the surface of a heating member, changes when ink is ejected by one of the liquid ejecting methods in accordance with the present invention.

The position and time at which the trailing end of the column of ink 7 comes in contact with the element substrate can be recorded by continuously observing, from above, the top surface of the heater 2 with the use of a microscope pre-focused upon the top surface of the heater 2. According to this recording method, as the trailing end of the column of ink 7 comes close to the top surface of the heater 2, upon which the microscope has been prefocused, a substantially circular shape, that is the cross sectional shape of the column of ink 7, begins to appear in the field of the microscope. The following is the observation of the process of contact between the trailing end of the column of ink 7 and the heater 2, made at the time when the aforementioned cross sectional shape of the column of ink 7 begins to appear in the field of the microscope. FIGS. 3, (*a*)–(*c*), are schematic horizontal cross sectional views of the essential portion of a liquid ejecting head in accordance with the present invention, and sequentially depict the state of the adjacencies of the heater 2. While the bubble 6 grows, the ink 3 is pushed away from the surface of the heater 2 by the bubble 6. Then, as the trailing end of the column of ink 7 comes close enough to the surface of the heater 2, the substantially circular shape, that is, the cross sectional shape F of the column of ink 7, appears.

The time at which the bubble 6 pops, or becomes integrated with the atmosphere, can be recorded by continuously observing the bubble 6 from above the orifice plate 4 with the use of another optical microscope while adjusting the focal distance of the microscope as necessary. Further, the conventional structural members of the head may be replaced with transparent structural members so that the essential portion of the liquid ejecting head can be observed through the side wall of the head. Also, two or more observational methods may be employed in combination.

The present invention can be put to practical use by designing the measurements and shapes of the various components of a liquid ejecting head, the position at which a bubble grows, the size of a bubble, the physical properties of ink, and the like, in accordance with the needs of the user of a liquid ejecting apparatus.

Hereinafter, the preferred embodiments of the present invention in the form of a liquid ejecting head will be described. However, the present invention is not to be limited by these embodiments.

Embodiment 1

Figure 4:
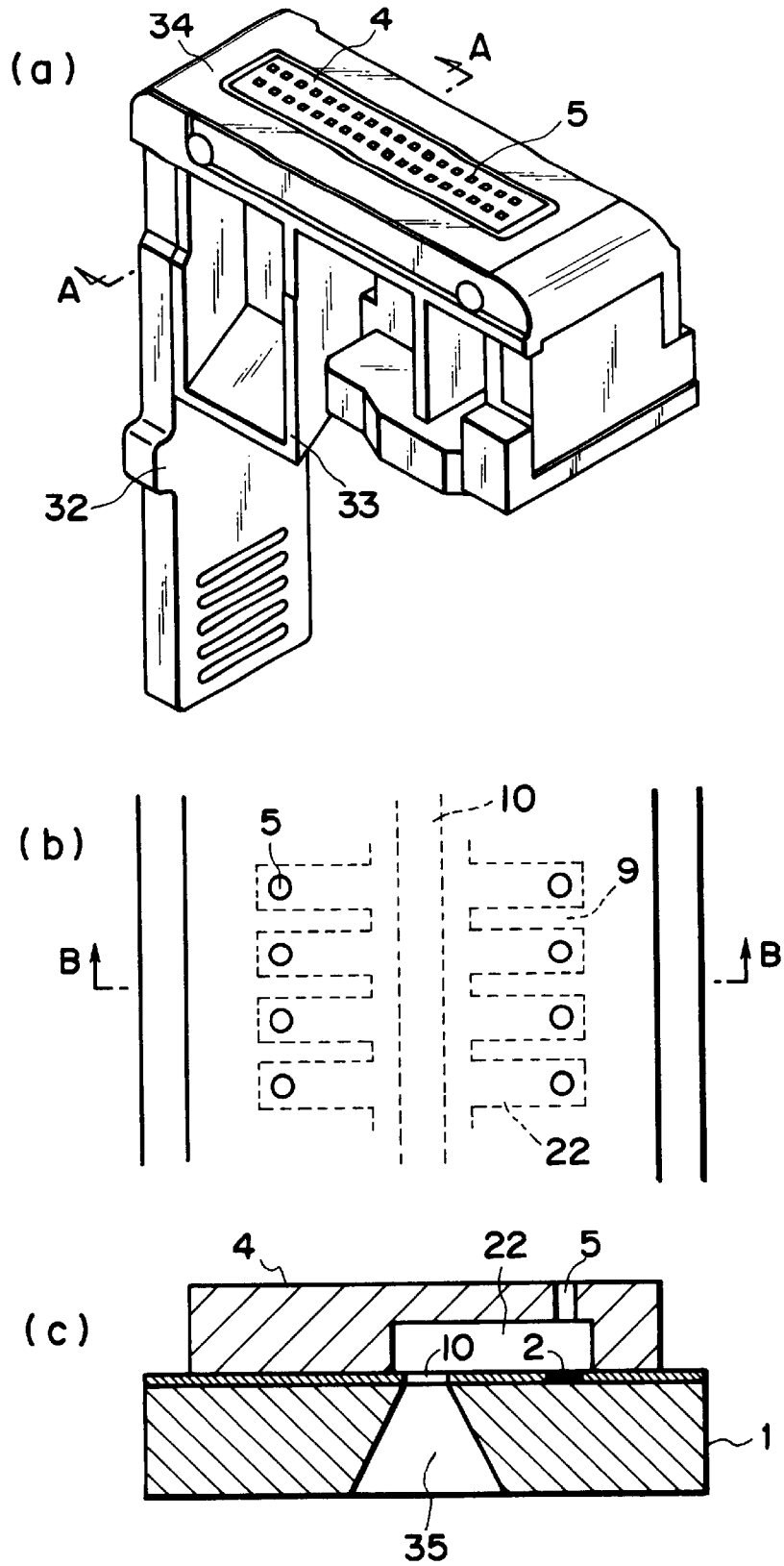
FIGS. 4, (*a*)–(*c*), are schematic drawings of a liquid ejecting head compatible with a liquid ejecting method in accordance with the present invention, (a) being a schematic perspective view, (b) being a schematic top view, and (c) being a schematic sectional view along a line B—B in (b).

FIGS. 4, (*a*)–(*c*), are schematic drawings of an example of a liquid ejecting head to which a liquid ejecting method in accordance with the present invention is applicable. FIG. 4, (*a*) is a schematic perspective view of a side shooter type liquid ejecting head, and depicts the external appearance of the head. FIG. 4, (*b*), is a schematic transparent plan of the essential portion of the head illustrated in FIG. 4, (*a*), and shows the ink ejection orifices aligned in two straight lines, the ink ejection orifices in one line being staggered from those in the other line. FIG. 4, (*c*), is a schematic sectional view of the head, along a line B–B in FIG. 4, (*b*).

In FIG. 4, a referential character 1 designates an element substrate constituted of a piece of thin film of silicon formed with the use of a thin film formation technology or the like. On the element substrate 1, an electrothermal transducer as a heater 2 is formed. There is disposed an ejection orifice 5 above the heater 2, squarely facing the heater 2. More specifically, the ink ejecting head is provided with a plurality of ejection orifices 5, which are aligned in two straight lines, the ejection orifices in one line being staggered from those in the other line, as illustrated in FIGS. 4, (*a*) and (*b*). The element substrate 1 is glued to a portion of a supporting member formed in the shape of a letter L. Also to the supporting member 32, a wiring substrate 34 is fixed, and the actual wiring portion of the wiring substrate 34 and the wiring portion of the element substrate 1 are electrically connected by wire bonding. The supporting member 32 is formed of, for example, aluminum in consideration of processability or the like. A mold member 33 supports the supporting member 32 by allowing a portion of the supporting member 32 to be inserted in the mold member 33, and also supplies liquid (for example, ink) to the ejection orifices of the head from a liquid storing portion (unillustrated) through the liquid flow paths formed in the mold member 33. Further, the mold member 33 functions as a member for removably attaching the liquid ejecting head in accordance with the present invention to a liquid ejecting apparatus, which will be described later, and for accurately positioning the liquid ejecting head relative to the liquid ejecting apparatus.

The element substrate 1 is provided with a liquid flow path 35 which is extended through the element substrate 1. The liquid supplied through the liquid supply path of the mold member 33 is supplied farther to the ejection orifices through the liquid flow path 35 of the element substrate 1. The liquid flow path 35 is also connected to a plurality of liquid flow paths 22, each of which leads to an ejection orifice, playing a role as a common liquid chamber.

Referring to FIG. 4, (*c*), this liquid ejecting head has an ink supply orifice 10, which is formed in the bottom portion of the head by anisotropic etching. Ink is supplied to all ink flow paths through the ink supply orifice 10 from an unillustrated ink container. Almost directly below each ejection orifice 5, a heater 2 is disposed to eject the ink, in the form of an ink droplet, from the ejection orifice 5 by giving thermal energy to the ink supplied through the ink flow path. The liquid flow path components such as divider walls are formed with the use of a well-known manufacturing method which employs exposing technologies, etching technologies, and the like.

The specifications of the liquid ejecting head used in this embodiment, and the conditions under which the head is driven, are as follows. The driving signal given to the heater 2 is rectangular in waveform, 14.5 V in voltage, and 4 $\mu$sec in pulse width. The ink is composed by dissolving C.I. food black 2 in the mixture of diethylene glycol (20 $) and water (80 $) by 4 $. The ejection orifice 5 is a cylindrical hole with a diameter of 21 pm. The size of the heater 2 is 30 dun×30 pm. The height of a liquid flow path, that is, the height of the gap between the substrate 1 and the orifice plate 4, is 13 qua, and the thickness of the orifice plate 4 is 25 $\mu$m.

The volume of each ink droplet ejected when the liquid ejecting head with the above measurement and shape was driven was approximately $10\times10^{-15}$ $m^3$, and the ejection velocity was approximately 13 m/sec. Both the volume and velocity scarcely fluctuated. The observation by a microscope revealed that it was 8 $\mu$sec after a driving signal was inputted, when the trailing end of the column of ink 7 (interface between bubble 6 (vapor) and ink) made contact with the heater 2, and it was 9 $\mu$sec after a driving signal was inputted, when the bubble 6 became integrated with the atmosphere. In other words, the bubble 6 becomes integrated with the atmosphere approximately 1 $\mu$sec after the column of ink 7 made contact with the heater 2. Referring to FIG. 1, (*e*), the position on the heater 2, with which the trailing end of the column of ink 7 made contact was adjacent to the cross section of the central axis of the ejection orifice 5 and the substrate 1. According to the continuous observation by the microscope, when the trailing end portion of the ink droplet 8 was passing by the ejection orifice 5, it was perfectly straight, and the ink droplet 8 landed on the recording medium 21 with desirable accuracy. Further, even when a plurality of prints were continuously produced, the housing of the recording apparatus was not filled with ink mist, and recording quality remained excellent.

COMPARATIVE EXAMPLE 1

A liquid ejecting head, the orifice plate thickness of which was reduced to 19 μm, was produced. The specifications of the head except for the orifice plate thickness were the same as those of the head in the first embodiment. The volume of each ink droplet ejected when this liquid ejecting head was driven was approximately $10\times10^{-15}$ $m^3$, and the ejection velocity was approximately 14 m/sec.

Figure 11:
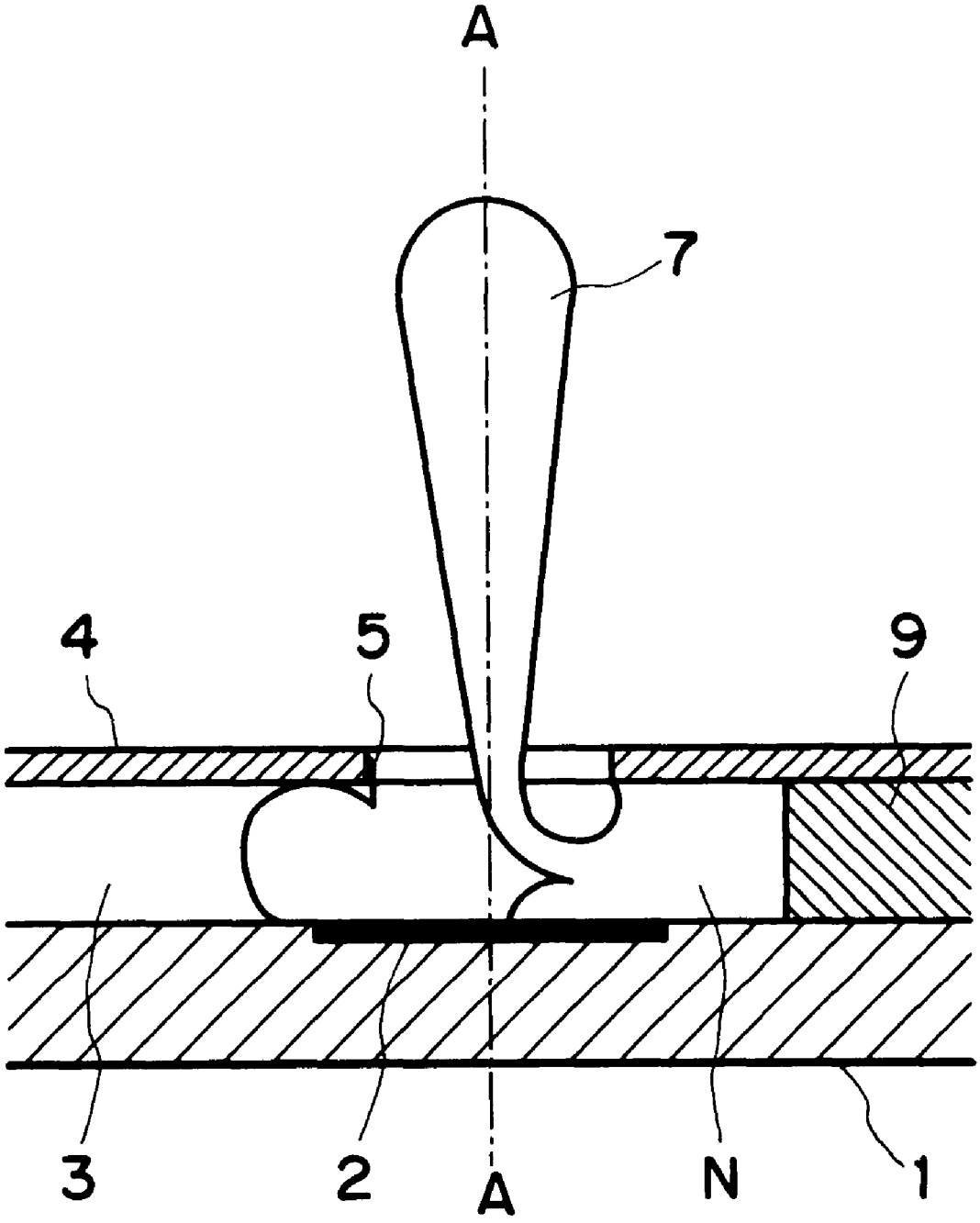
FIG. 11 is a schematic sectional view of the essential section of a liquid ejecting head, and depicts a liquid ejecting method based on conventional technologies.

The observation by a microscope revealed that it was 6.5 μsec after a driving signal was inputted, when the bubble 6 became integrated with the atmosphere. The position at which the trailing end N' of the column of ink 7 made contact with the heater 2 was not adjacent to the cross section of the central axis of the ejection orifice 5 and the substrate 1; it was closer to a corner of the liquid flow path (FIG. 11). According to the continuous observation by the microscope, when the trailing end portion of the ink droplet 8 was passing by the ejection orifice 5, it did not appear to be perfectly straight; it appeared to have a curvature.

COMPARATIVE EXAMPLE 2

A liquid ejecting head, the orifice plate thickness of which was further reduced to 10 dun, was produced. The specifications of the head other than the orifice plate thickness were the same as those of the head in the first embodiment. When this liquid head was driven, the volume of each ink droplet was approximately $9\times10^{-15}$ $m^3$, and the ejection velocity was approximately 18 m/sec.

The observation by a microscope revealed that it was 4.0 μsec after a driving signal was inputted, when the bubble 6 became integrated with the atmosphere. This is a rather short time. The trailing end N' of the column of ink 7 made contact with the element substrate after the integration of the bubble 6 with the atmosphere. The position on the heater 2, with which the trailing end N' of the column of ink 7 made contact was not adjacent to the cross section of the central axis of the ejection orifice 5 and the substrate 1; it was closer to a corner of the liquid flow path (FIG. 11). According to the continuous observation by the microscope, when the trailing end portion of the ink droplet 8 was passing by the ejection orifice 5, it did not appear to be perfectly straight; it appeared to have a curvature.

As described above, in the cases of the first embodiment, and the first and second comparative examples, the operational conditions other than the orifice plate thickness were fixed; only the orifice plate thickness was varied. As a result, it was discovered that the threshold value for the orifice plate thickness regarding whether or not the column of ink remained straight, and the resultant ink droplet flew straight, was approximately 19 dun. This value of 19 dun is not an absolute value. Rather, it changes in response to the measurements and shapes of various components of a liquid ejecting head, the driving condition for each liquid ejecting head, and the physical properties of ink, and the like factors. Therefore, the orifice plate thickness should be adjusted as necessary, which is desirable to create the optimum design for a liquid ejecting head. There is a tendency that with gradual increase in the orifice plate thickness from 25 pm, the difference between the liquid ejecting method in accordance with the present invention and the conventional liquid ejecting method gradually disappears.

Embodiment 2

Figure 5:
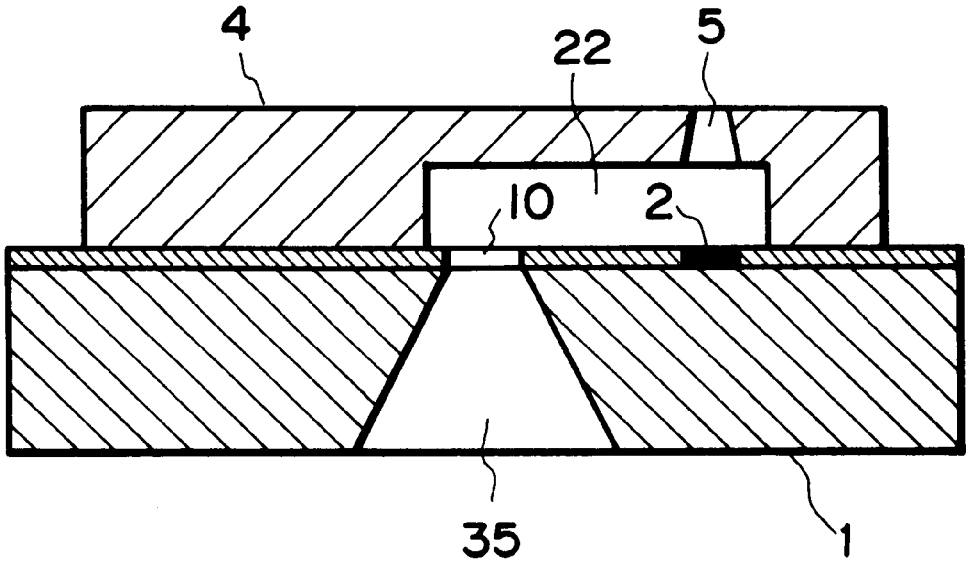
FIG. 5 is a sectional view of another liquid ejecting head in accordance with the present invention.

FIG. 5 is a schematic sectional view of another liquid ejecting head in accordance with the (present invention. The thickness of the orifice plate 4 of this head is 19 μm, which is the same as that of the first comparative embodiment. Also, the ejection orifice 5 of this head is tapered. More specifically, the diameter of the outward opening of the ejection 3) orifice 5 of the orifice plate 4 is 21 pm, and the diameter of the inward opening of the ejection orifice 5, that is, the opening closer to the heater 2, is 30 μm. The specifications of this head other than the differences described above are the same as those of the first embodiment.

When the liquid ejecting head with the above measurement and shape was driven, the volume of each ink droplet was approximately $11\times10^{-15}$ $m^3$, and the ejection velocity was approximately 17 m/sec. Both the volume and velocity scarcely fluctuated. The observation by a microscope revealed that it was 7 μsec after a driving signal was inputted, when the trailing end of the column of ink 7 (interface between bubble 6 (vapor) and ink) made contact with the heater 2, and it was 7.5 μsec after a driving signal was inputted, when the bubble 6 became integrated with the atmosphere. In other words, the contact was ahead of the integration; the bubble 6 became integrated with the atmosphere approximately 0.5 μsec after a portion of the interface between the vapor and liquid made contact with the heater 2. The position at which the trailing end of the column of ink 7 made contact with the heater 2 (FIG. 1, (*e*)) was adjacent to the cross section of the central axis of the ejection orifice 5 and the substrate 1. According to the continuous observation by the microscope, when the trailing end portion of the ink droplet 8 was passing by the adjacencies of the ejection orifice 5, it was perfectly straight, and the ink droplet 8 landed on the recording medium 21 with desirable accuracy. Further, even when a plurality of prints were continuously produced, the housing of the recording apparatus was not filled with ink mist, and recording quality remained excellent.

Embodiment 3

Figure 6:
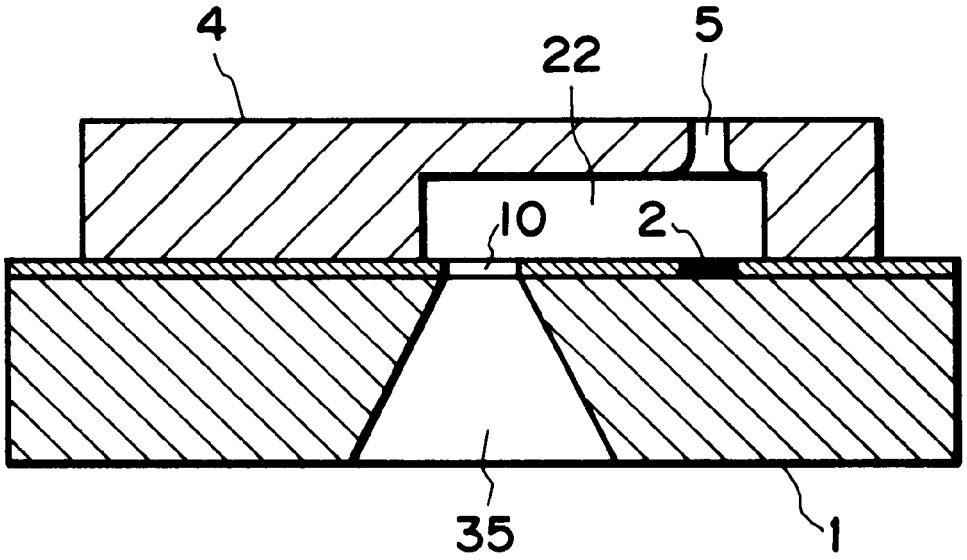
FIG. 6 is a sectional view of another liquid ejecting head in accordance with the present invention.

FIG. 6 is a schematic sectional view of another liquid ejecting head in accordance with the present invention. The liquid ejecting head used in this embodiment, and the conditions under which the head was driven, are as follows. That is, in order to give a rounded edge to the inward opening of the ejection orifice 5 of the liquid ejecting head, that is, the opening on the liquid flow path side, the orifice plate was formed of nickel by electrical casting. The thus formed orifice plate 5 was attached to the structural member for the liquid flow paths with the use of heat and pressure after being accurately positioned relative to the structural member.

The driving signal given to the heater 2 was rectangular in wave-form, 14.5 V in voltage, and 4 μsec in pulse width. The ink was composed by dissolving C.I. food black 2 in the mixture of diethylene glycol (20%) and water (80%) by 4 $. The size of the heater 2 is 30 dun×30 dun. The height of a liquid flow path, that is, the height of the gap between the substrate 1 and the orifice plate 4, was 13 dun. The thickness of the orifice plate 4 was 16 μm. The ejection orifice 5 of this head was tapered. More specifically, the diameter of the outward opening of the ejection orifice 5 of the orifice plate 4 was 21 μm, and the diameter of the inward opening of the ejection orifice 5, that is, the opening closer to the heater 2, was 33 μm. The ejection orifice 5 was a cylindrical hole with a diameter of 21 μm.

When the liquid ejecting head with the above measurement and shape was driven, the volume of an ink droplet was approximately $10\times10^{-15}$ m$^3$, and the ejection velocity was approximately 17 m/sec. Both the volume and velocity scarcely fluctuated. The observation by a microscope revealed that it was 7 μsec after a driving signal was inputted, when the trailing end of the column of ink 7 (interface between bubble 6 (vapor) and ink) made contact with the heater 2, and it was 7.5 μsec after a driving signal was inputted, when the bubble 6 became integrated with the atmosphere. In other words, the bubble 6 becomes integrated with the atmosphere approximately 0.5 μsec after the column of ink 7 made contact with the heater 2. Referring to FIG. 2, (*e*), the position on the heater 2, with which the trailing end of the column of ink 7 made contact, was adjacent to the cross section of the central axis of the ejection orifice 5 and the substrate 1. According to the continuous observation thereafter by the microscope, when the trailing end portion of the ink droplet 8 was passing by the adjacencies of the ejection orifice 5, it was perfectly straight, and the ink droplet 8 landed on the recording medium 21 with desirable accuracy. Further, even when a plurality of prints were continuously produced, the housing of the recording apparatus was not filled with ink mist, and recording quality remained excellent.

Embodiment 4

A liquid ejecting head, the orifice plate thickness of which was further reduced to 13 μm, was produced. The specifications of the head other than the orifice plate thickness were the same as those of the head in the third embodiment. When this liquid ejecting head was driven, the volume of each ink droplet was approximately $10\times10^{-15}$ m$^3$, and the ejection velocity was approximately 18 m/sec. Both the volume and velocity scarcely fluctuated. The observation by a microscope revealed that it was 6 μsec after a driving signal was inputted, when the trailing end of the column of ink 7 (interface between bubble 6 (vapor) and ink) made contact with the heater 2, and it was 6.5 μsec after a driving signal was inputted, when the bubble 6 became integrated with the atmosphere. In other words, the contact between the column of liquid and the heater was ahead of the integration of the bubble 6 and the atmosphere; the integration of the bubble 6 with the atmosphere was approximately 0.5 μsec after the contact between the column of ink 7 and the heater 2. The position on the heater 2, with which the trailing end of the column of ink 7 made contact (FIG. 2, (*e*)), was adjacent to the cross section of the central axis of the ejection orifice and the substrate 1. According to the continuous observation thereafter by the microscope, when the trailing end portion of the ink droplet 8 was passing by the adjacencies of the ejection orifice 5, it was perfectly straight, and the ink droplet 8 landed on the recording medium 21 with desirable accuracy. Further, even when a plurality of prints were continuously produced, the housing of the recording apparatus was not filled with ink mist, and recording quality remained excellent.

Embodiment 5

A liquid ejecting head, the orifice plate thickness of which was further reduced to 10 dun, was produced. The specifications of the head other than the orifice plate thickness were the same as those of the head in the third embodiment. When this liquid ejecting head was driven, the volume of an ink droplet was approximately $10\times10^{-15}$ m$^3$, and the ejection velocity was approximately 20 m/sec. Both the volume and velocity scarcely fluctuated. The observation by a microscope revealed that it was 5.5 μsec after a Q1riving signal was inputted, when the trailing end of the column of ink 7 (interface between bubble 6 (vapor) and ink) made contact with the heater 2, and it was 5.5 μsec after a driving signal was inputted, when the bubble 6 became integrated with the atmosphere. In other words, the contact between the column of liquid and the heater was simultaneous with the integration of the bubble 6 and the atmosphere. The position on the heater 2, with which the trailing end of the column of ink 7 made contact (FIG. 2, (*e*)), was adjacent to the cross section of the central axis of the ejection orifice and the substrate 1. According to the continuous observation thereafter by the microscope, when the trailing end portion of the ink droplet 8 was passing by the adjacencies of the ejection orifice 5, it was perfectly straight, and the ink droplet 8 landed on the recording medium 21 with desirable accuracy. Further, even when a plurality of prints were continuously produced, the housing of the recording apparatus was not filled with ink mist, and recording quality remained excellent.

As is evident from the above description of the embodiments, even if the orifice plate thickness is reduced, ink can be ejected in the form of an ink droplet in a desired manner by tapering the ejection orifice 5, that is, by making the inward opening of the ejection orifice, that is, the opening on the liquid flow path side, larger than the outward opening of the ejection orifice, more specifically, gradually decreasing the diameter of the ejection orifice 5 from the inward opening, that is, the opening on the liquid flow path side, toward the outward opening. This is thought to be for the following reason. That is, according to this tapering design, the size of the column of ink 7, which is directly related to the liquid ejection performance of a liquid ejecting head, can be made relatively large. With the relative increase in the volume of the column of ink 7, the distance between the column of ink 7 and the heater 2 becomes smaller. As a result, the bubble 6 becomes integrated with the atmosphere directly below the column of ink 7 and directly above the heater 2. Consequently, the trajectory of an ink droplet is improved; an ink droplet flies straighter. Further, being able to use an orifice plate thinner than that for a conventional head is important in that it can reduce the cost and time necessary for the production of a liquid ejecting head.

Giving a smooth, rounded edge to the inward opening of the ejection orifice, that is, the opening on the liquid flow path side, makes it possible to eject a desirable ink droplet. This is thought to be for the following reason. That is, when the edge portion of the inside opening of the ejection orifice, that is, the opening on the liquid low path side, is smoothly rounded, the ink film C (FIG. 2, (*c*)) formed between the column of ink 7 and the bubble 6 can smoothly move around the aforementioned edge portion. Therefore, the ink film C is less likely to break; in other words, the bubble 6 is less likely to pop at the edge portion, postponing the integration between the bubble 6 and the atmosphere. As a result, the liquid droplet trajectory is further straightened.

Further, making the inside opening of an ejection orifice, that is, the opening on the liquid flow path side, greater than the outside opening of the ejection orifice, preferably by tapering the ejection orifice, and also giving a rounded edge to the inside opening of the ejection orifice 5, that is, the opening on the liquid flow path side, makes it possible to obtain synergistic effects from the combination of the effects which are peculiar to the correspondent head structures.

Next, referring to FIGS. 7, (*a*)–(*f*), a manufacturing method for a liquid ejecting apparatus to which a liquid ejecting method in accordance with the present invention is applicable will be described.

Figure 7:
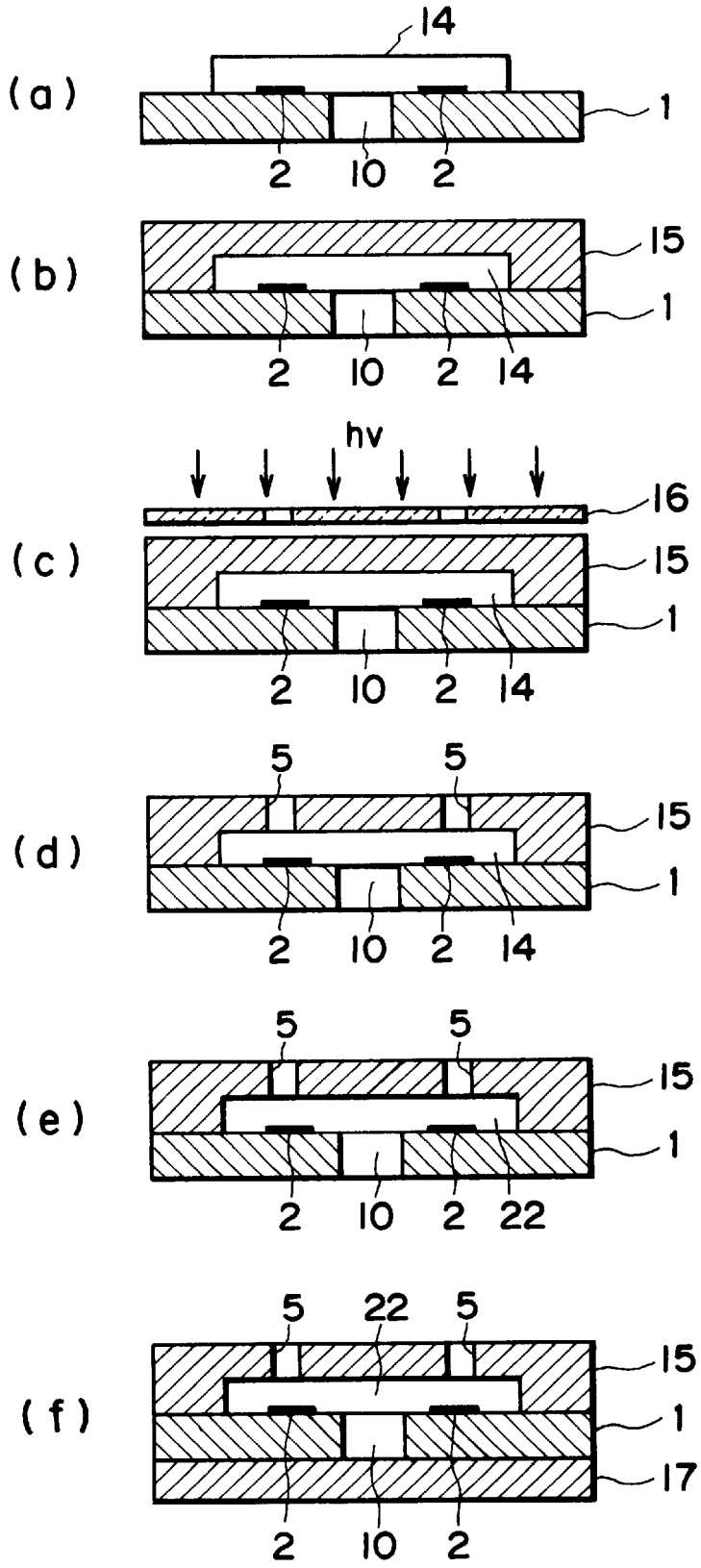
FIGS. 7, (*a*)–(*f*), are sectional views of the essential portion of a liquid ejecting head in accordance with the present invention, and depict an example of a method for producing a liquid ejecting head in accordance with the present invention.

First, referring to FIG. 7, (*a*), a piece of substrate 1 formed of glass, ceramic, plastic, metallic, or the like material is prepared. This type of substrate 1 plays a role as one of the structural members for liquid flow paths. There is no specific limitation in terms of its shape and material as long as it can serve a supporting member for the layers of material which form the ink flow paths and ink ejection orifices, which will be described later. On the substrate 1, a desired number of ejection energy generating means 2, for example, electrothermal transducers or piezoelectric elements, are disposed. In order to eject recording liquid droplets, in other words, in order to record images, ejection energy is given to the ejection energy generating means 2. When electrothermal transducers, for example, are employed as the aforementioned ejection energy generating means 2, these transducers heat the recording liquid adjacent to the transducers, causing the recording liquid to change its state so that ejection energy is generated. On the other hand, when piezoelectric (elements are employed, ejection energy is generated by the mechanical vibrations of these elements.

To the ejection energy generating means 2, input electrodes (unillustrated) are connected, through which control signals for activating these elements are inputted. Generally, in addition to the ejection energy generating means 2, various functional layers such as a protection layer are provided on the substrate 1 to improve the durability of these ejection energy generating means 2. Provision of such functional layers does not contradict the gist of the present invention.

In FIG. 7, (*a*), the substrate 1 is provided in advance with a hole 10 through which ink is supplied from the back side of the substrate 1. As for the method for creating the hole 10, any means may be employed as long as it can create holes in the substrate 1. For example, it may be a mechanical means such as a drill, or optical means such as a laser. Further, the hole 10 may be created by a method which involves resist patterns and chemical etching. Obviously, the ink supply hole 10 may be formed in the member in which the ejection orifices 5 are formed, instead of being created in the substrate 1. In this case, the hole 10 is designed into a resin pattern.

Next, an ink flow path pattern is formed of dissolvable resin, on the substrate 1, so that it covers the aforementioned ejection energy generating means 2, as shown in FIG. 7, (*a*). As for the most commonly used method for forming the ink flow path pattern, there is a means for forming the pattern with%he use of photosensitive material. But, it is possible to use other means such as screen printing. In the case of a photosensitive material based means, it is possible to use possible resist, or negative resist with changeable dissolvability, because the ink flow path pattern 14 must be dissolvable.

As for the method for forming a resist layer, when a substrate provided with an ink supply hole is used, the resist layer is desired to be formed by laminating: photosensitive material is dissolved in an appropriate solvent; and the mixture is coated on a piece of polyethyleneterephthalate film or the like, and dried to form a sheet of dry film. As for the material for the dry film, it is desired to use photolytic high polymer compound in the vinylketone group, such as polymethylisopropyl ketone and polyvinyl ketone, for the following reason. That is, before being irradiated with light, these chemical compounds display the same characteristics as high polymer compound; more specifically, they can be easily formed into a sheet of extremely thin film, which can be easily laid across the ink supply hole. Further, the aforementioned mixture of the photosensitive material and solvent may be coated on the substrate 1 by spin coating, roller coating, or the like method, after filling the ink supply hole 10 with such filler than can be removed in a latter process.

Referring to FIG. 7, (*b*), next, a cover resin layer 15 is formed by an ordinary spin coating, a roller coating, or the like coating method, on the dissolvable resin layer 14 formed in the ink flow path pattern, as described above. Regarding the process in which the cover resin layer 15 is formed, it is important that the solvent for the material for the cover resin layer 15 does not deform the dissolvable resin layer 14. More specifically, when selecting a solvent for the material for the cover resin layer 15, it is necessary to select such a solvent that does not dissolve the dissolvable resin layer 14 while the mixture, which is formed by dissolving the material for the cover resin layer 15 into a solvent, is coated on the dissolvable resin layer 14 by a spin coating, a roller coating, or the like coating method.

Here, the cover resin layer 15 will be described. The material for the cover resin layer 15 is desired to be photosensitive, because ink ejection orifices can be easily and precisely formed in such material. Further, the material for the cover resin layer 15 is required to have high mechanical strength suitable for structural material, adherence to the substrate 1, ink resistance, as well as capability to accommodate high resolution necessary to create microscopic patterns. It has been known that epoxy resin hardened by a cationic polymerization process possesses excellent strength, adherence, and ink resistance, which are required of the structural material for the cover resin layer 15, and also that when this epoxy resin is in solid state at the normal temperature, it displays superb characteristic suitable for a patterning process.

First, epoxy resin hardened by cationic polymerization process is higher is crosslinking density (Tg) than epoxy resin hardened with the use of acid anhydride or amine, and therefore, the former displays superb characteristics required of structural material. Further, with the use of epoxy resin which is in solid state at the normal temperature, the polymerization initiation seeds, which generate from the cationic polymerization initiator as the resin is irradiated with light, are prevented from dispersing into the epoxy resin. Therefore, excellent patterning accuracy is realized.

When forming the cover resin layer on the dissolvable resin layer, it is desired that the cover resin layer is formed by spin coating the dissolvable resin layer with the solution composed by dissolving the resin for the cover resin layer, which is in solid state at the normal temperature, into a solvent. With the use of spin coating, which is one of the thin film coating technologies, the cover resin layer 15 can be uniformly and also precisely formed. As a result, the distance between the ejection energy generating means 2 and the ejection orifice (distance OH) can be reduced, which was impossible with the use of any of the conventional methods. Consequently, it becomes possible to easily produce a liquid ejecting head capable of ejecting liquid droplets of an extremely small size.

When the aforementioned so-called negative type photosensitive material is used as the material for the cover resin layer, normally, exposure light is reflected by the suitable surface, and also, scum (development process residue) is generated. However, according to the present invention, the ejection orifice pattern is formed on the ink flow paths formed of the dissolvable resin. Therefore, the effect of the exposure light reflection from the substrate surface can be ignored. The scum generate during the development process is lifted off during the process in which the dissolvable resin formed in the ink flow path pattern is washed out. Therefore, the scum does not leave any ill effect.

As for the epoxy resin which is in solid state at the normal temperature, the following can be listed; the product of chemical reaction between bisphenol A and epychlorohydrine, the molecule weight of which is approximately 900 or more, the product of chemical reaction between bromo containing phenol A and epichlorohydrine, product of chemical reaction between phenol novolak, or o-cresol novolak, and epichlorohydrine, multifunctional epoxy resin with a skeleton constituted of oxycyclohexane, which is described in Japanese Laid-Open Patent Applications Nos. 161973/1985, 221121/1988, 9216/1989 and 141219/1990.

As for the photo-cationic polymerization initiator for hardening the aforementioned epoxy resin, it is possible to list aromatic iodonium salt, aromatic sulfonium salt (J. POLYMER SCI: Symposium No. 56 383-395 (1976)), SP-150, SP-170, and the like, marketed by Asahi Denko Co., Ltd.

The above listed photo-cationic polymerization initiator may be used together with a reducing agent, so that the cationic polymerization is accelerated (crosslinking density increases compared to photocationic polymerization alone). However, when photocationic polymerization initiator is used along with a reducing agent, it is necessary to choose a reducing agent of the so-called redox type, that is, such a reducing agent that does not react at the normal temperature; more specifically, one that reacts only when temperature is above the normal temperature (preferably, 60° C. or higher). As for such a reducing agent, copper compound, in particular, copper triflate (trifluoromethanesulfonated copper (II)), is most suitable in consideration of reactivity and dissolvability into epoxy resin. Other reducing agents such as ascorbic acid or the like are also effective. When a much higher crosslinking density is necessary to increase the number of nozzles (for high speed printing), to make it possible to use nonneutral ink (for improving water resistance of coloring agents), or to accomplish the like objectives, the crosslinking density can be increased by dissolving the aforementioned reducing agent into the solvent in which the cover resin layer is dipped and heated after the process in which the cover resin layer is developed.

If necessary, additives may be added to the aforementioned compound. For example, in order to decrease the elasticity of the epoxy resin, a flexibility increase agent may be added, or in order to enhance the adhesion between the substrate and the cover resin layer, silane coupler may be added.

Next, the cover resin layer 15 formed of the aforementioned photosensitive compound is exposed through a mask 16 (pattern exposure) as shown in FIG. 7, (*c*). Since the photosensitive cover resin layer 15 is negative, the portions of the layer 15, which correspond to the ink ejection orifices and electrical connection, are shielded by the mask. The exposing ray may be chosen from among ultraviolet ray, Deep-ultraviolet ray, electron beam, X-rays, and the like, according to the photosensitivity range of the employed photocationic polymerization initiator.

In all the manufacturing steps up to this point, positioning can be done with the use of a conventional photolithographic technology, which makes it possible to drastically increase manufacturing accuracy compared to a method in which an orifice plate and a substrate are separately manufactured, and then are adhered to each other. Next, the photosensitive cover rein layer 15 exposed through the mask 16 (pattern exposure) may be heated to accelerate the photolytic reaction as necessary. Since the photosensitive cover resin layer is formed of the epoxy resin which is in solid state at the normal temperature as described above, the dispersion of the cationic polymerization seeds generated by the pattern exposure are well controlled. Therefore, a high level of patterning accuracy can be realized.

Next, the photosensitive cover resin layer 15 exposed through the mask 16 is developed with the use of an appropriate solvent, creating the ejection orifices 15 as shown in FIG. 7, (*d*). During this process of dissolving away the unexposed portions of the photosensitive cover resin layer 15, the dissolvable resin layer 14 for forming the ink flow paths may also be dissolved away. However, generally, there are disposed a plurality of heads of the same or different type on each piece of substrate, and they are separated into individual liquid ejecting heads through a dicing process. Therefore, in order to deal with the refuse during the dicing, the photosensitive cover resin layer 15 alone may be selectively dissolved, so that the dissolvable resin layer 14 for forming the ink flow paths 22 is left undissolved as shown in FIG. 7, (*d*) (resin layer 14 remains occupying the spaces which will constitute future ink flow paths, preventing the refuse from entering ink flow paths). The resin layer 14 is dissolved after the dicing (FIG. 7, (*e*)). The scum (development residue) which generates while developing the photosensitive cover resin layer 15 is dissolved away along with the dissolvable resin layer 14, being prevented from remaining in the ejection orifices.

When necessary to increase the aforementioned crosslinking density, that is, to further harden the photosensitive cover resin layer 15, or the orifice plate, the orifice plate is dipped and heated in a solution containing a reducing agent, after the ink flow paths 22 and ejection orifices 15 are formed. With this process, the crosslinking density of the photosensitive cover resin layer 15, or the orifice plate, is further increased. Also, the photosensitive cover resin layer 15 is drastically improved in terms of adhesiveness to the substrate, and ink resistance. Of course, the process, in which the photosensitive cover resin layer 15 is dipped and heated in the copper ion containing solution, may be carried out, with no problem whatsoever, immediately after the ejection orifices 5 are formed by exposing the photosensitive cover resin layer 15 through the mask 16 and developing it. In this case, the dissolvable resin layer 14 is dissolved out thereafter.

As for such a reducing agent, any reductive substance may be employed. However, such chemical compounds as copper triflate, copper acetate, copper benzoate, and the like, which contain copper ions are pore effective. In particular, copper triflate is extremely effective. In addition to the above, ascorbic acid is also effective.

To the substrate on which the ink flow path and ink ejection orifices are formed through the above described steps, electrical connections (unillustrated) for driving an ink supplying member 17 and an ejection energy generating means 2 are made to complete a liquid ejecting head, or an ink jet head (FIG. 7, (*f*)).

In the case of the above described manufacture of a liquid ejecting head, the ejection orifices 5 are formed by photolithography. However, the manufacture of a liquid ejecting head in accordance with the present invention does not need to be limited to the above described method. For example, the ejection orifices 5 may be formed by dry etching or with the use of an excimer laser, employing a mask different from the aforementioned one. When the ejection orifices 5 are formed with the use of an excimer layer or by dry etching, the substrate is protected by the resin pattern, being prevented from being damaged by the laser or plasma, which makes it possible to produce a head which is more precise and reliable. Also, when the ejection orifices 5 or the like are formed by dry etching or with the use of an excimer laser, thermally curable resin can be used as the material for the cover resin layer 15, in addition to the photosensitive resin.

Next, an example of a liquid ejecting apparatus compatible with the aforementioned liquid ejecting head will be described.

Figure 8:
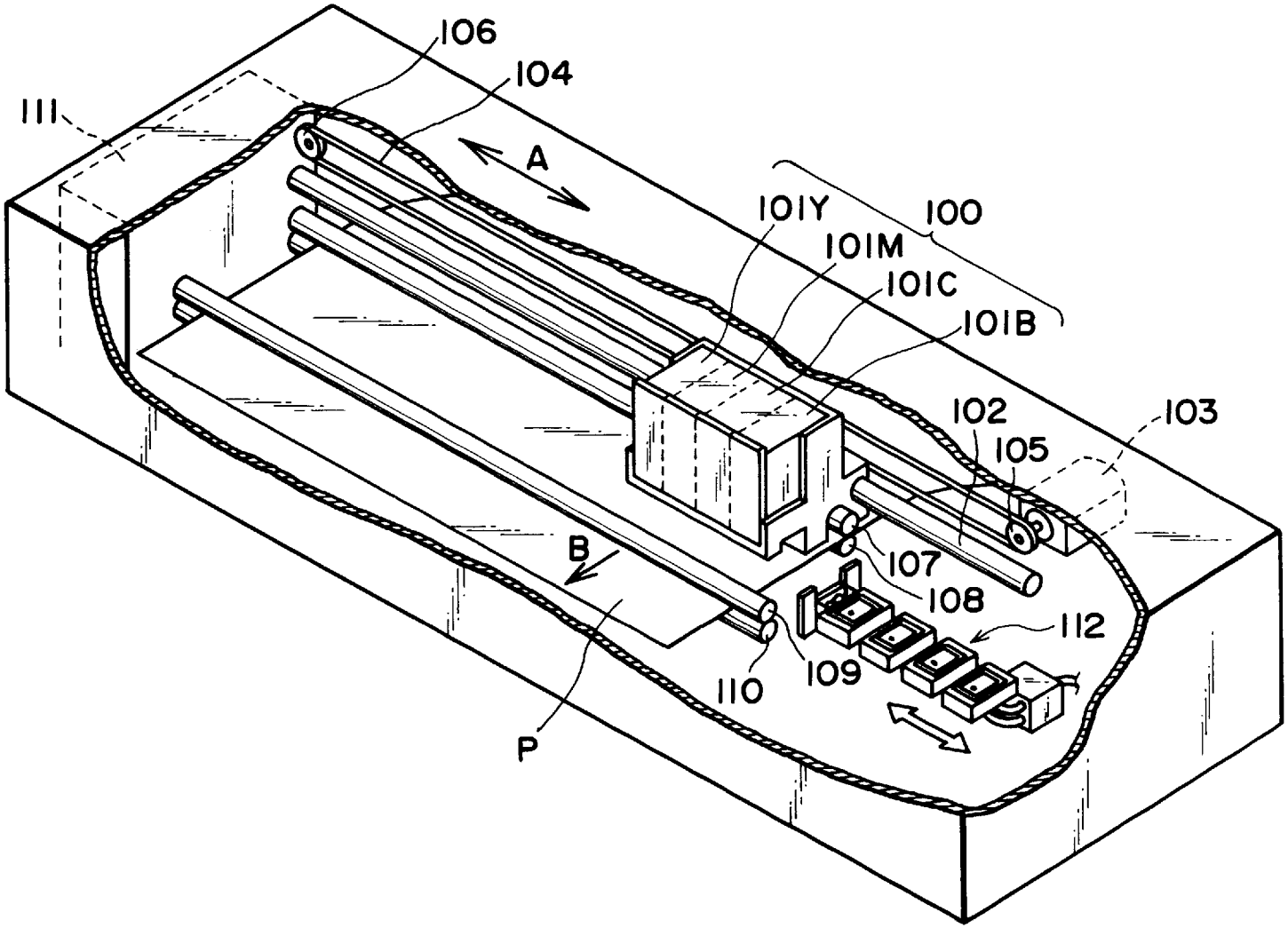
FIG. 8 is a partially broken perspective view of the essential portion of a liquid ejecting apparatus in accordance with the present invention.

FIG. 8 is a schematic perspective view of the essential portion of such a liquid ejecting apparatus. A referential character 100 designates a carriage on which the aforementioned liquid ejecting head is removably installable. In this embodiment, four liquid ejecting heads are installed corresponding to four inks, as the liquids to be ejected, of different color. Four heads are mounted on the carriage 100 in-combination with the container 101Y for yellow ink, container 1O1M for magenta ink, container 1O1C for cyan ink, and container 1O1B for black ink, one for one.

The carriage 100 is supported by a guide shaft 102, being enabled to be driven forward or backward in the direction indicated by an arrow mark A, on the guide shaft 102, by an endless belt 104 driven forward or backward by a motor 103. The endless belt 104 is wrapped around pulleys 105 and 106.

The recording sheet P as recording medium is intermittently conveyed in the direction indicated by an arrow mark B, which is perpendicular to the arrow A direction. The recording sheet P is held and carried by a pair of roller units 107 and 108 and another pair of roller units 109 and 210, which are disposed on the upstream and downstream sides, respectively, relative to the moving direction of the recording sheet P, to give a predetermined amount of tension to the recording sheet P so that it is assured that the recording sheet P remains flat as it is conveyed. The force for driving each roller unit is provided by a driving portion 211. However, the liquid ejecting apparatus may be structured so that the aforementioned driving motor is also used to drive each roller unit.

The carriage 100 stops at the home position, at the beginning of the recording operation or as necessary. At this position, there are provided capping members 212 for capping the ejection orifices of each head. The capping member 212 is connected to a suction based head performance recovery means (unillustrated) which sucks the ink (liquid) through the ejection orifices to prevent the ejection orifices from being clogged.

Figure 9:
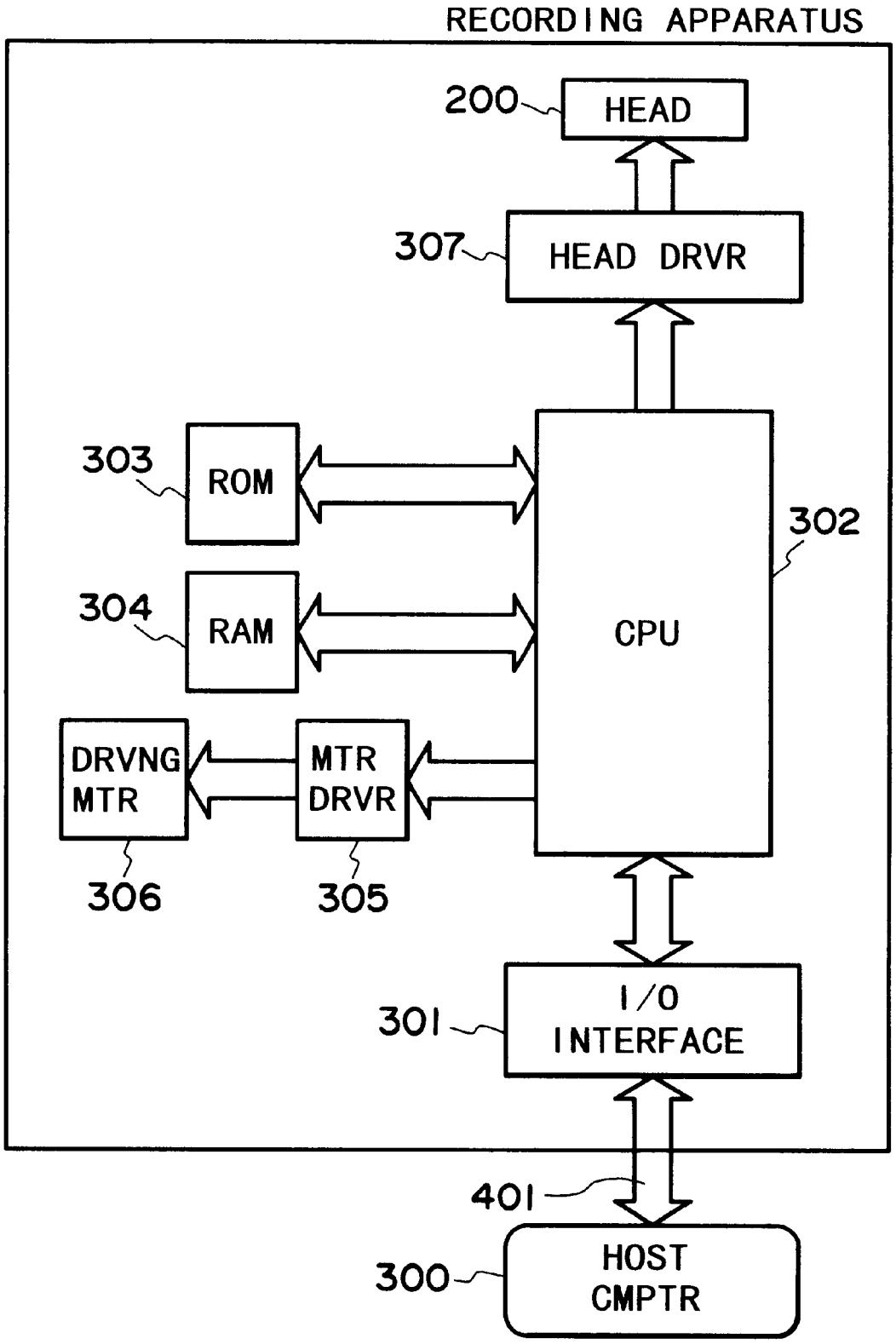
FIG. 9 is a block diagram of an example of a liquid ejecting apparatus in accordance with the present invention.

FIG. 9 is a block diagram for an example of a liquid ejecting apparatus in accordance with the present invention. The recording apparatus receives printing data in the form of control signals from a host computer 300. The printing data are temporarily stored in an internal input/output interface 301 of the recording apparatus. At the same time, they are converted into such data that are processable in the recording apparatus, and are inputted into the CPU 302 which doubles as a means for supplying head driving signals. The data inputted into the CPU 302 are processed by the CPU 302, based on the control program stored in a ROM 303, with the use of peripheral units such as a RAM 304; the data are converted into printable data (image data).

The CPU 302 also creates driving data for driving the driving motor 305 which moves the recording sheet P and recording head 200 in synchronism with the image data. The image data and motor driving data are transmitted to the head 200 and driving motor 306 through a head driver 307 and a motor driver 305, and drive the heads 200 and driving motor 306, respectively, with controlled timings, creating an image.

Figure 10:
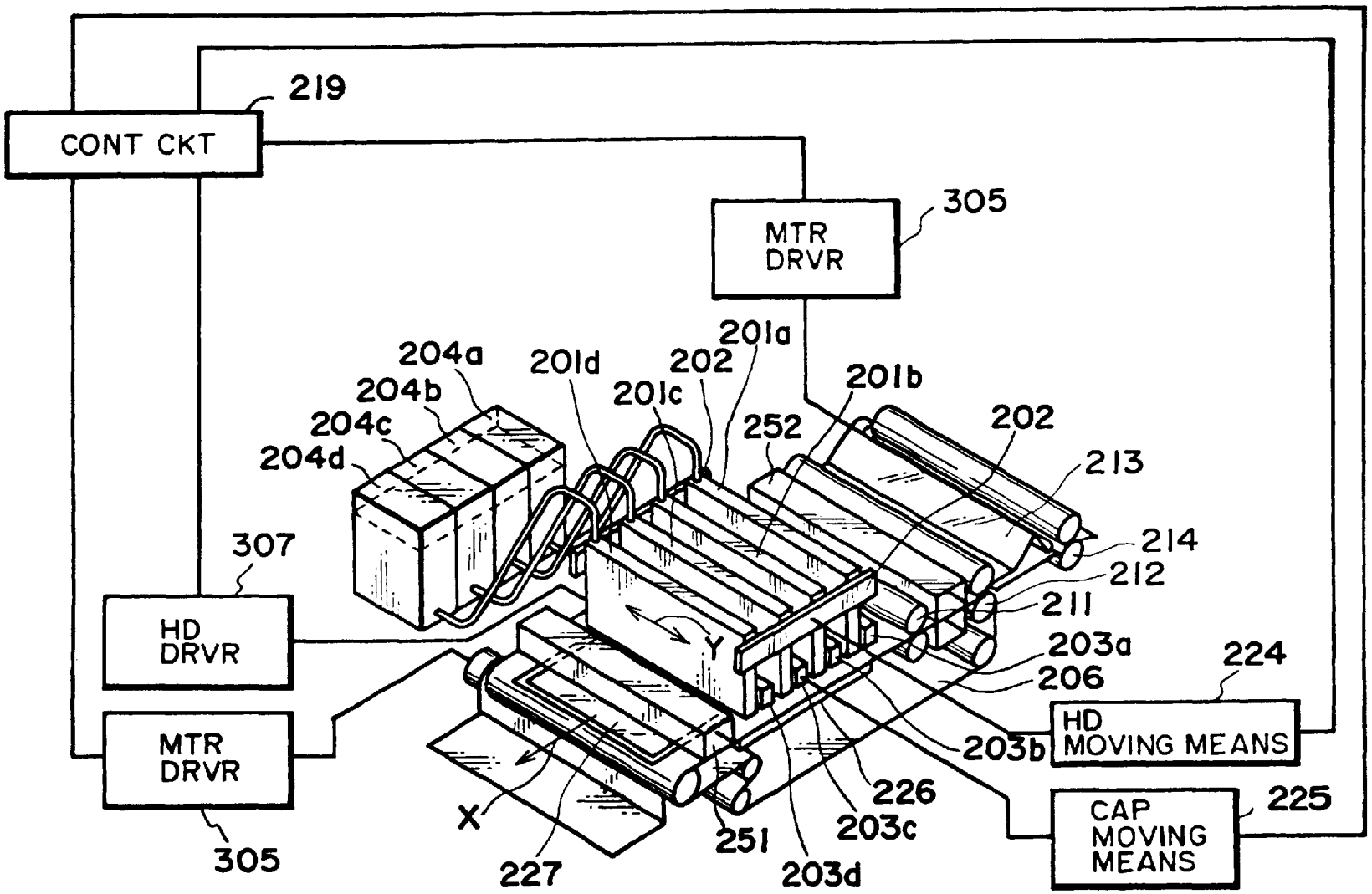
FIG. 10 is a perspective schematic view of another example of a liquid ejecting apparatus in accordance with the present invention, and depicts the essential portion of the recording system thereof.

Next, an example of an ink jet recording system which records an image on a piece of recording medium by using a liquid ejecting head in accordance with the present invention as a recording head, will be described. FIG. 10 is a schematic perspective view of the essential portion of a recording system as an example of a liquid ejecting apparatus in accordance with the present invention. The liquid ejecting head in this embodiment is a full-line head, and is equipped with four heads 201*a*–201*d* correspondent to four colors, which are yellow (Y), magenta (M), cyan (C), and black (Bk). The four heads are fixedly supported in parallel to each other with a predetermined interval, being perpendicular to the recording medium conveyance direction, by a holder 202. Each head is enabled to cover the entire recordable range of a piece of recording medium 150, and comprises a plurality of ejection orifices disposed in the direction indicated by an arrow mark Y across the recordable range with an interval of 360 dpi.

To each of the heads 201*a*–210*d*, driving signals are supplied from a head driver 307 which constitutes a driving signal supplying means. Also to each of the heads 201*a*–201*d*, four color inks Y, M, C and Bk as the liquids to be ejected are supplied from correspondent ink containers 204*a*–204*d*.

Below the heads 201*a*–201*d*, head caps 203*a*–203*d* which contain an ink absorbing member formed of sponge or the like material, are correspondingly positioned. When the recording heads 201*a*–201*d* are not in operation, these caps 203*a*–203*d* cover the correspondent head 201*a*–201*d* to maintain the head performance. A referential character 206 designates a conveyer belt which constitutes a means for conveying various recording media described in the preceding embodiments of the present invention. The conveyer belt 206 is routed through a predetermined path by various rollers, and is driven by a driving roller controlled by a motor driver 305.

The ink jet recording system in this embodiment comprises a pre-processing apparatus 251 and a post-processing apparatus 252. The preprocessing apparatus 251 is located on the upstream side of the recording medium conveyance path, and carries out various processes upon the recording medium before an actual recording process, whereas the post-processing apparatus 252 is located on the downstream side and carries out various post-processes upon the recording medium. The content of the pre- and post-processings varies depending upon the type of recording medium upon which recording is made, or ink type. For example, the recording medium such as metal, plastic or ceramic is exposed to ultraviolet rays and ozone prior to recording to activate the surface of the recording medium so that ink adhesion to the recording medium is improved. In the case of recording medium such as plastic, which easily collects static electricity, dust is liable to adhere to the surface of the recording medium due to the static electricity, and this dust sometimes interferes with recording. In such a case, an ionizing apparatus may be used to remove the static electricity from the recording medium prior to recording so that the dust is released from the recording medium. Further, when fabric is used as the recording medium, the fabric may be treated with a substance selected from among an alkaline substance; a water soluble substance, a synthetic high polymer, water soluble metallic salt, urea, and thiourea prior to printing. The selection of pre-processings is not limited to those listed above. For example, a process for adjusting the recording medium temperature to a proper temperature for printing may be employed. As for the postprocessing, the recording medium on which ink has been adhered may be thermally treated to fix the ink to the recording medium, or may be irradiated with ultraviolet rays to promote the fixation of the ink to the recording medium. Also, the processing agents which have been used in the pre-processing and remain inactivated in or on the recording medium are washed away.

The present invention is such an invention that is applicable to a printer, as a peripheral image outputting apparatus for an information processing apparatus such as a computer, which records an image on a piece of recording medium by ejecting liquid in the form of a liquid droplet. It is also applicable to a copying machine integrated with a reader or the like, a facsimile machine with sending and receiving functions, an information processing apparatus, such as a word processor, equipped with a printing portion. Further, it is applicable to an industrial recording apparatus, or an industrial recording system, intricately integrated with various processing apparatuses. A term "recording" in this specification means "providing" a piece of recording medium with not only images, such as characters or graphics, which have specific meaning, but also meaningless patterns.

The liquid to be ejected may be selected from among various substances such as ink which can be made to be in liquid form at least at the moment of ejection. For example, it may be an ink which is in a solid state at the normal temperature but liquefies above a certain temperature. In other words, it does not matter whether a substance is in a solid state at the normal temperature or not, as long as it can be in a liquid state at the moment of ejection. As for recording medium, the following may be listed: paper, thread, fiber, woven material, leather, metal, plastic (for example, OHP sheet, compact disc, ornamental plate, or the like), glass (for example, color filter, or the like), lumber, ceramic, or material with three dimensional network structure, for example, sponge.

While the invention has been described with reference to the structures disclosed herein, it is not confined to the details set forth and this application is intended to cover such modifications or changes as may come within the purposes of the improvements or the scope of the following claims.

What is claimed is:

1. A liquid ejection method using a substrate comprising a base plate and a heat generating member provided on the base plate, wherein a bubble is created in liquid on the heat generating member by thermal energy generated by the heat generating member, by which a droplet of the liquid is ejected, said method comprising the steps of:

contacting of the substrate by a portion of a gas-liquid interface between the bubble and the liquid by deformation of the bubble; and causing the bubble to be in fluid communication with ambient atmosphere simultaneously with or after the contact between the portion of the gas-liquid interface and the substrate, wherein the portion of the gas-liquid interface that contacts the substrate is not always in contact with the substrate.

2. A method according to claim 1, wherein the contact between the portion of the gas-liquid interface and the substrate occurs during a period when the bubble collapses.

3. A method according to claim 1, wherein the bubble takes a ring-shaped configuration having a substantially annular cross-section when the portion of the gas-liquid interface comes into contact with the substrate.

4. A method according to claim 1, wherein the portion of the gas-liquid interface becomes a trailing edge of a column of the liquid to be formed into the droplet.

5. A method according to claim 1, wherein a portion of the substrate to which the portion of the gas-liquid interface is contacted is a portion of the heat generating member.

6. A method according to claim 1, wherein the bubble is created by boiling the liquid.

* * * * *

UNITED STATES PATENT AND TRADEMARK OFFICE

CERTIFICATE OF CORRECTION

PATENT NO. : 6,582,060 B1 
DATED : June 24, 2003
INVENTOR(S) : Koichi Kitakami et al.

It is certified that error appears in the above-identified patent and that said Letters Patent is hereby corrected as shown below:

Column 4,
Line 65, (Close up right margin); and
Line 66, (Close up left margin).

Column 5,
Line 16, “shorter” should read -- shooter --; and
Line 66, “serious” should read -- a serious --.

Column 7,
Lines 4, 11 and 18, “cross sectional” should read -- cross-sectional --; and
Line 8, “cross” should read -- cross- --.

Column 8,
Line 41, “(20$)” should read -- (20%) --;
Line 42, “(80$)” should read -- (80%) --; and “4$.” should read -- 4%. --.
Line 43, “21pm.” should read -- 21$\mu$m --; and “30 dunx30” should read -- 30$\mu$mx30 --;
Line 44, “pm.” should read -- $\mu$m. --; and
Line 45, “13 qua,” should read -- 13$\mu$m, --.

Column 9,
Line 52, “19 dun.” should read -- 19 $\mu$m. --; and
Line 60, “25 pm,” should read -- 25$\mu$m, --.

Column 10,
Line 5, “21 pm,” should read -- 21$\mu$m, --;
Line 54, “4$.” should read -- 4%. --;
Line 55, “30 dunx30 dun.” should read -- 30$\mu$m x 30$\mu$m. --; and
Line 57, “13 dun.” should read -- 13$\mu$m. --.

Column 11,
Line 60, “10dun,” should read -- 10$\mu$m, --; and
Line 67, “Q1riving” should read -- driving --.

Column 13,
Line 16, “(elements” should read -- elements --;
Line 43, “with%he” should read -- with the --; and
Line 66, “than” should read -- that --.

UNITED STATES PATENT AND TRADEMARK OFFICE

CERTIFICATE OF CORRECTION

PATENT NO. : 6,582,060 B1
DATED : June 24, 2003
INVENTOR(S) : Koichi Kitakami et al.

It is certified that error appears in the above-identified patent and that said Letters Patent is hereby corrected as shown below:

Column 14,
Line 66, “listed;” should read -- listed: --.

Column 15,
Line 17, “above listed” should read -- above-listed --; and
Line 34, “nonneutral” should read -- non-neutral --.

Column 16,
Line 46, “pore” should read -- more --; and
Lines 51, 56 and 60, “above described” should read -- above-described --.

Column 17,
Line 14, “in-combination” should read -- in combination --.

Signed and Sealed this

Thirtieth Day of December, 2003

JAMES E. ROGAN
*Director of the United States Patent and Trademark Office*